United States Patent [19]

Hagel et al.

[11] 4,049,431

[45] Sept. 20, 1977

[54] HIGH STRENGTH FERRITIC ALLOY

[75] Inventors: William C. Hagel, Ann Arbor, Mich.; Frederick A. Smidt, Springfield, Va.; Michael K. Korenko, Richland, Wash.

[73] Assignee: The United States of America as represented by the United States Energy Research and Development Administration, Washington, D.C.

[21] Appl. No.: 728,361

[22] Filed: Sept. 30, 1976

[51] Int. Cl.[2] ..... C22C 38/22; C22C 38/24; C22C 38/26

[52] U.S. Cl. ..... 75/126 C; 75/126 E; 75/126 F; 148/37; 176/88; 176/91 R

[58] Field of Search ..... 176/88, 91 R; 148/37; 75/126 C, 126 E, 126 F, 126 P

[56] References Cited

U.S. PATENT DOCUMENTS

| | | | |
|---|---|---|---|
| 2,848,323 | 8/1958 | Harris et al. | 75/126 P |
| 3,663,208 | 5/1972 | Kirby et al. | 75/128 V |

*Primary Examiner*—Arthur J. Steiner

*Attorney, Agent, or Firm*—Dean E. Carlson; Richard E. Constant; Ignacio Resendez

[57] ABSTRACT

A high-strength ferritic alloy useful for fast reactor duct and cladding applications wherein an iron base contains from about 9% to about 13% by weight chromium, from about 4% to about 8% by weight molybdenum, from about 0.2% to about 0.8% by weight niobium, from about 0.1% to about 0.3% by weight vanadium, from about 0.2% to about 0.8% by weight silicon, from about 0.2% to about 0.8% by weight manganese, a maximum of about 0.05% by weight nitrogen, a maximum of about 0.02% by weight sulfur, a maximum of about 0.02% by weight phosphorous, and from about 0.04% to about 0.12% by weight carbon.

3 Claims, 1 Drawing Figure

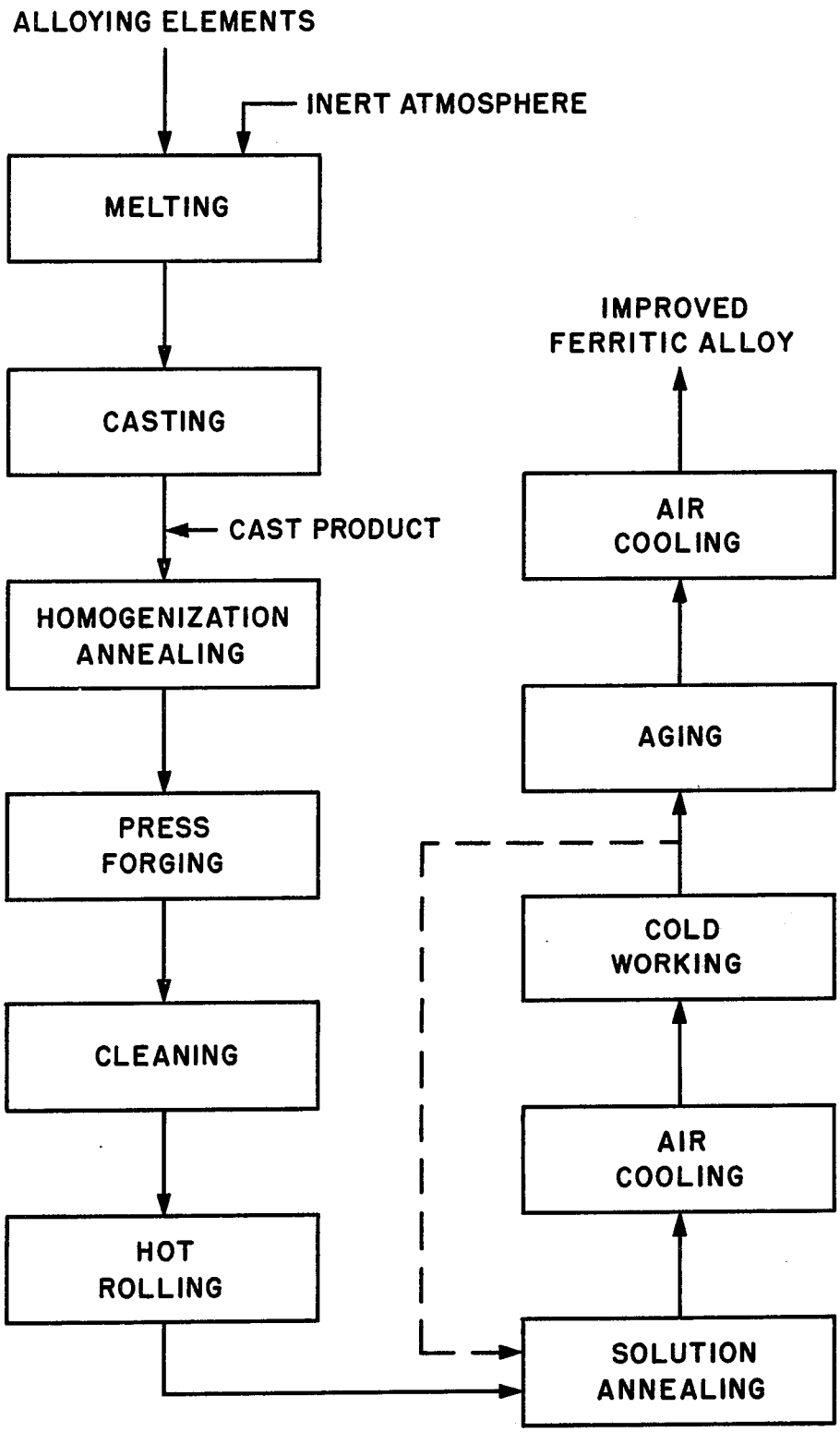
ALLOYING ELEMENTS
INERT ATMOSPHERE
MELTING
CASTING
CAST PRODUCT
HOMOGENIZATION ANNEALING
PRESS FORGING
CLEANING
HOT ROLLING
SOLUTION ANNEALING
AIR COOLING
COLD WORKING
AGING
AIR COOLING
IMPROVED FERRITIC ALLOY

HIGH STRENGTH FERRITIC ALLOY

BACKGROUND OF INVENTION

The invention relates to a high strength ferritic alloy.

Currently the liquid metal fast nuclear reactors are being designed to incorporate 20% cold worked 316 stainless steel (SS) for fuel cladding and duct applications. The ferritic class of materials have generally been considered inferior to 316 SS for this particular application in that they possess, as a group, inferior strength as compared to 316 SS at temperatures in the range of 500° to 700° C.

It would be commercially advantageous to design a ferritic alloy comparable in strength to 316 SS since ferritic materials have certain advantages as compared to the austenitic class of alloys which includes 316 SS. Ferritic alloys generally have a higher swelling resistance under irradiation, and consequently have a longer service life; they absorb fewer neutrons and are therefore more economical in the power generation cycle; and they are more resistant to irradiation embrittlement, and thus reduce the spent fuel handling problems.

SUMMARY OF INVENTION

In view of the above, it is an object of this invention to provide a novel ferritic alloy which retains good strength characteristics in the range of 500° to 700° C.

It is a further object of this invention to provide a ferritic alloy useful for liquid metal breeder reactor duct and cladding applications.

It is a further object of this invention to provide a novel ferritic alloy having improved void swelling resistance.

It is a further object of this invention to provide a ferritic alloy having high temperature strength comparable to 316 SS and improved ductility after irradiation over 316 SS at said high temperatures.

It is a further object of this invention to provide a ferritic alloy having a relatively high concentration of molybdenum providing Laves phase precipitation and an improved strength in the range of 500° to 700° C.

Various other objects and advantages will appear from the following description of the invention and the most novel features will be pointed out hereinafter in connection with the appended claims. It will be understood that various changes in the details and composition of the alloy components which are herein described in order to explain the nature of the invention may be made by those skilled in the art without departing from the principles and scope of this invention.

The invention comprises a novel ferritic alloy which is useful for liquid metal breeder reactor duct and cladding applications, and contains from about 9% to about 13% by weight chromium (Cr), from about 4% to about 8% by weight molybdenum (Mo), from about 0.2% to about 0.8% by weight niobium (Nb), from about 0.1% to about 0.3% by weight vanadium (V), from about 0.2% by weight silicon (Si), from about 0.2% to about 0.8% by weight manganese (Mn), from about 0.04% to about 0.12% by weight carbon (C), a maximum of about 0.05% by weight nitrogen, a maximum of about 0.02% by weight sulfur, a maximum of about 0.02% by weight phosphorous, and the remainder iron (Fe), wherein the ferritic alloy has an improved strength comparable to 20% cold worked 316 SS at temperatures in the range of 500° to 700° C.

DESCRIPTION OF DRAWING

The drawing outlines a flow process for obtaining the ferritic alloy of this invention.

DETAILED DESCRIPTION

The alloy of this invention may be prepared using the flow sequence illustrated in the drawing. The alloying elements may be added to provide a composition having a general range of from about 9% to about 13% by weight Cr, from about 4% to about 8% by weight Mo, from about 0.2% to about 0.8% by weight Nb, from about 0.1% to about 0.3% by weight V, from about 0.2% to about 0.8% by weight Si, from about 0.2% to about 0.8% by weight Mn, from about 0.04% to about 0.12% by weight C, a maximum of about 0.05% by weight nitrogen, a maximum of about 0.02% by weight sulfur, a maximum of about 0.02% by weight phosphorous, with the balance Fe. While maximum concentrations have been assigned to nitrogen, sulfur and phosphorous, these concentrations are preferably maintained as low as possible, and it is desirable not to have these present in the alloy. The alloying elements may be fed into a suitable furnace such as an induction furnace, and may be melted in air wherein the surface of the melt is protected by a layer of argon or other suitable gas. In the alternative, it may be desirable to melt the ferritic alloy composition in an inert atmosphere to protect against nitrogen absorption, as known in the art. The alloying elements may be added as ferrous alloys except that it may be desirable to use pure additions of carbon, aluminum and electrolytic iron. Aluminum is added as a deoxidant, but does not form a part of the final product.

After melting, the melt or heat was poured into a suitable ingot form such as cylindrical ingots having dimensions of 90 millimeters (mm) by 320 mm. The casting may then be subjected to a two hour soak or solution anneal at a temperature range of from about 1125° C to about 1225° C, and generally at about 1175° C. The solution annealed cast ingot was then press forged at a suitable temperature range such as between about 1125° C and about 1225° C, and generally at about 1175° C, into a sheet bar of suitable dimensions such as 25 mm thick by 150 mm wide by 685 mm long. For test purposes, the sheet bar was then grit blasted or cleaned to remove surface oxidation and sectioned into 150 mm lengths for hot rolling. This hot rolling involved initially broad rolling to a 205 mm width followed by straight rolling to a 2 mm thickness. Thirteen millimeter wide strips were then removed and solution annealed at from about 1100 to about 1200° C, and generally at about 1150° C, for from about 0.5 to about two hours, or such as about one-half hour in a protective hydrogen atmosphere before air cooling. The hydrogen atmosphere was provided in order to prevent oxidation.

The solution annealed strips were then air cooled and then subsequently cold worked to a 20% reduction from the 2 mm thickness to a 1.5 mm thickness. After the final cold working, the strips were subjected to an aging treatment at a temperature of from about 700° to about 760° C, and generally at about 730° C, for from about 0.5 to about 2 hours. After the age treatment, the strips were air cooled to ambient temperature.

Table I illustrates the chemical compositions of four alloys which were made and produced by the above described process including the cold working, forging, aging, etc., treatments, For convenience and ease of description the alloys are herein referred to as alloys D56, D57, D58 and D59.

Table II illustrates the specific temperatures, times, etc., that were employed in processing the four alloys, to obtain the results that will be hereinafter provided.

In all of the four runs shown in Table I, the Laves phase precipitation acted as the primary ferritic alloy strengthener in conjunction with the strengthening from the carbide phases. Laves phase precipitation was increased by the relatively high additions of Mo as noted in ferritic alloys D56 and D57. This is directly contrary to the teaching of the prior art since the Laves phase is normally considered undesirable because it generally reduces ductility. This Laves phase precipitation increase which yields the strengthened ferritic alloy has resulted in ferritic alloys that are suitable for liquid metal breeder reactor duct and cladding applications and which have superior physical properties as will be described hereinbelow.

The terms % E., % R.A., and ksi used in the tables refer to percent elongation, percent reduction in area, and thousand pounds per square inch respectively.

As shown in Table III, alloys D56 and D57, which are the subject of this invention, have a neutron absorption cross section in a fast flux spectrum relative to 316 SS that is very comparable. In point of fact, alloy D57 would be preferred over alloy D56 for reactor applications since the relative absorption (defined as 100% times the absorption of the alloy divided by the absorption of 316 SS) of alloy D56 exceeds that of the standard 316 SS. Alloy D56, which has a greater amount of Mo which in turn accounts for the increase in relative absorption, may be highly suitable for non-nuclear applications such as for mufflers and steam turbine blades, where a high strength may be required at relatively high temperatures. Alloys having this concentration of Mo would be much more economical than conventionally used alloys because of their higher strengths and consequent longer lifetimes.

Alloy D57 falls within the general range recited hereinabove, and also within the preferred range, which is from about 0.04 to about 0.07% by weight C, from about 0.3 to about 0.6% by weight Mn, from about 0.2 to about 0.5% by weight Si, from about 9.5 to about 11.5% by weight Cr, from about 5.5 to about 6.5% by weight Mo, from about 0.3 to about 0.—6% by weight Nb, from about 0.1 to about 0.3 weight percent V, and the balance Fe. This range is preferred to assure that there are optimum amounts of carbide and Laves strengthening phases. This alloy may be particularly useful for duct and cladding applications in liquid metal cooled fast reactors.

Table IV illustrates the room temperature tensile properties of the high Mo ferritic alloys having the compositions listed in Table I. As the molybdenum content increases from alloy D59 to alloy D56, the strength generally increases; however, alloy D57 has the optimum combination of strength and ductility. Increasing the molybdenum content to 8% in alloy D56 causes a significant decrease in ductility.

In order to test the stability of these alloys in long time high temperature service applications, these materials were aged at 474° C for 500 hours and subsequently tensile tested. The results of these tests are illustrated in Table V. Only the highest molybdenum material, alloy D56, displayed any significant degradation after this stability test. This is further indication that the 5.5 to 6.5 weight percent molybdenum range is optimum.

The elevated temperature tensile properties of the subject ferritic alloys are presented in Table VI. These date illustrate that, in the temperature range of duct and cladding applications, the higher molybdenum alloys maintain a high strength. The hot hardness data of Table VII also confirms the high strength of these materials and also further illustrates the advantages of higher molybdenum contents.

The creep rupture data of Tables VIII and IX are relevant to fuel cladding and duct applications since the internal gas and sodium flow pressures subject the material to similar continuous loading situations. These data again illustrate the increase of mechanical strength upon increasing the molybdenum content. When the 100 hour stress rupture values are compared to the value of 35 ± 5 ksi for 316 stainless steel, it can be seen that both alloy D56 and alloy D57 have comparable properties to 316 stainless steel.

One of the more significant drawbacks for the use of 316 SS in reactor applications is the fact that it has a low irradiation induced swelling resistance. The materials of this invention provide a significant improvement in swelling resistance over 316 SS. Based on ion irradiation experiments, alloy D57 is expected to have better than a factor of 10 increase in swelling resistance over 316 SS at a fluence of $2 \times 10^{23}$ neutrons per square centimeter ($n/cm^2$) energy greater than 0.1 million electron volt ($E > 0.1$ MeV). More specifically, from 2.8 MeV iron ion irradiation experiments, the maximum swelling rate at the peak swelling temperature of 500° C is 0.0062% per displacement per atom (dpa) (iron ion) as determined at 250 dpa. In addition, from 1.0 MeV electron irradiation experiments, the maximum swelling rate at the peak swelling temperature of 550° C is 0.564% per dpa (electron).

Currently available correlations of iron ion damage and neutron damage yields a swelling rate of 0.013% per dpa under neutron irradiation. Similar correlations for electron damage yields a swelling rate of 0.035% per dpa. These values were averaged to give a rate of 0.024% per dpa under neutron irradiation for the alloy of this invention having the composition of D-57 which results in a swelling of less than 5% at the goal fluence of $2.2 \times 10^{23}$ $n/cm^2$ ($E > 0.1$ Mev).

A critical test for an alloy with a potential duct and cladding application is its fabricability via the tube drawing process. Alloy D57 has been successfully drawn from 1 inch diameter bar to 0.180 inch OD tubing 0.008 inch thick using a warm working temperature of 300 ± 50° C. Thus, it has been successfully demonstrated that a commercial vendor can fabricate the material to the desired shape.

This invention provides a novel alloy composition that is of superior strength to other ferritic materials, is especially adaptable for use at high temperatures, and possesses excellent swelling resistance.

TABLE I

COMPOSITION OF HIGH MOLYBDENUM FERRITIC ALLOYS

| | Element, % by Weight, Balance Iron | | | | | | | | | | | |
|---|---|---|---|---|---|---|---|---|---|---|---|---|
| Alloy | C | Mn | Si | Cr | Ni | Mo | Nb | V | N | P | S | Other |
| D56 | 0.06 | 0.45 | 0.31 | 9.39 | — | 7.98 | 0.54 | 0.31 | 0.052 | 0.012 | 0.008 | — |

TABLE I-continued

COMPOSITION OF HIGH MOLYBDENUM FERRITIC ALLOYS

| | Element, % by Weight, Balance Iron | | | | | | | | | | | |
|---|---|---|---|---|---|---|---|---|---|---|---|---|
| Alloy | C | Mn | Si | Cr | Ni | Mo | Nb | V | N | P | S | Other |
| D57 | 0.055 | 0.45 | 0.31 | 10.50 | — | 5.96 | 0.54 | 0.33 | 0.048 | 0.013 | 0.007 | — |
| D58 | 0.11 | 0.47 | 0.37 | 12.52 | — | 3.93 | 0.53 | — | 0.050 | 0.012 | 0.007 | 1.4 Ti |
| D59 | 0.06 | 0.43 | 0.36 | 12.57 | — | 3.92 | 0.52 | 0.34 | 0.073 | 0.012 | 0.005 | — |

TABLE II

Processing Conditions For High Molybdenum Ferritic Alloys

| Alloy | 2-Hour Soaking Temp., ° C | Forging Temp., ° C | Hot-Rolling Temp., ° C | Solution Treatment[a] Temp., ° C | 20% Cold Reduction, mm | Aging[b] Temp., ° C |
|---|---|---|---|---|---|---|
| D56 | 1175 | 1175 | 1175 | 1150 | 2 → 1.5 | 730 |
| D57 | 1175 | 1175 | 1175 | 1150 | 2 → 1.5 | 730 |
| D58 | 1230 | 1205 | 1095 | 1095 | 2 → 1.5 | 730 |
| D59 | 1230 | 1205 | 1095 | 1095 | 2 → 1.5 | 730 |

[a]Solution treated or austenitized for 0.5 hour and air cooled.
[b]Aged for one hour and air cooled

TABLE III

RELATIVE NEUTRON ABSORPTION FOR FAST FLUX REACTOR SPECTRUM

| Alloy | Percent Absorption |
|---|---|
| D56 | 102 |
| D57 | 97 |
| D58 | 90 |
| D59 | 91 |

* Relative to 316 Stainless Steel.

TABLE IV

ROOM TEMPERATURE TENSILE PROPERTIES OF FERRITIC ALLOYS

| Alloy | 0.2% Yield Strength, ksi | Tensile Strength, ksi | % E | % R.A. |
|---|---|---|---|---|
| D56[(a)] | 110.3 | 112.5 | 4.0 | 4.0 |
| | | 110.8 | 0.7 | 1.7 |
| | 110.7 | 122.1 | 0.7 | 0.7 |
| D57[(a)] | 91.5 | 134.2 | 11.0 | 17.9 |
| | 83.4 | 125.9 | 11.2 | 19.1 |
| D58[(b)] | 89.9 | 132.8 | 5.0 | 4.6 |
| | 92.4 | 139.8 | 10.7 | 9.5 |
| D59[(b)] | 90.9 | 106.4 | 11.7 | 24.4 |
| | 90.1 | 105.3 | 13.7 | 21.4 |

[(a)]Alloys were solution-treated (1150° C/0.5 hr/AC), 20% cold reduced, aged (730° C/1 hr/AC).
[(b)]Alloys were solution-treated (1095° C/0.5 hr/AC), 20% cold reduced, aged (730° C/1 hr/AC).

TABLE V

Room Temperature Tensile Properties of Ferritic Alloys Following Exposure At 474° C For 500 Hours

| Alloy[a] | 0.2% Offset Yield Strength, ksi | Tensile Strength ksi | % E | % R.A. |
|---|---|---|---|---|
| D56 | — | 91.7 | 0.7 | 1.7 |
| | — | 93.4 | 0.7 | 0.7 |
| D57 | 86.4 | 128.5 | 10.9 | 17.9 |
| | 84.7 | 126.8 | 10.7 | 16.7 |
| D58 | 89.7 | 138.3 | 8.5 | 7.9 |
| | 91.6 | 138.7 | 8.7 | 11.2 |
| D59 | 92.7 | 108.0 | 15.5 | 25.4 |
| | 94.5 | 109.1 | 12.5 | 22.3 |

[a]All alloys were heat treated according to Table II prior to phase stability age.

TABLE VI

ELEVATED TEMPERATURE TENSILE PROPERTIES

| Alloy[a] | 0.2% Offset Yield Strength, ksi | Tensile Strength ksi | % E | % R.A. |
|---|---|---|---|---|
| | | 550° C | | |
| D56 | 85.3 | 105.2 | 2.5 | 11.0 |
| D57 | 68.9 | 85.9 | 5.5 | 25.0 |
| D58 | 65.2 | 79.9 | 12.0 | 36.0 |
| D59 | 64.4 | 75.3 | 8.0 | 38.5 |
| | | 600° C | | |
| D56 | 77.5 | 93.7 | 7.0 | 11.0 |
| D57 | 62.1 | 74.0 | 11.0 | 26.5 |
| D58 | 54.1 | 63.8 | 15.5 | 48.0 |
| D59 | 56.4 | 62.0 | 12.0 | 47.5 |
| | | 650° C | | |
| D56 | 68.0 | 80.0 | 6.5 | 8.5 |
| D57 | 57.8 | 60.8 | 12.5 | 43.5 |
| D58 | 40.9 | 49.8 | 16.5 | 38.5 |
| D59 | 45.9 | 50.9 | 14.5 | 55.5 |

[a]All alloys were heat treated according to Table II.

TABLE VII

Hot Hardness, (HV 10)[a] At Indicated Temperature, ° C

| Alloy | 510 | 540 | 565 | 595 | 620 | 650 | 675 | 705 |
|---|---|---|---|---|---|---|---|---|
| D56 | 262 | 246 | 228 | 210 | 172 | 160 | 140 | 111 |
| D57 | 248 | 231 | 214 | 197 | 170 | 149 | 135 | 107 |
| D58 | 207 | 190 | 174 | 152 | 138 | 117 | 93 | 81 |
| D59 | 198 | 177 | 166 | 146 | 130 | 108 | 89 | 71 |

[a](HV 10) = Vickers Hardness Test, 10 kilogram load

TABLE IX

HIGH TEMPERATURE CREEP RUPTURE TEST RESULTS

| Alloy No.[a] | Temp. C | Stress, ksi | Min. Creep Rate %/hr | Life, hr | % E | % R.A. |
|---|---|---|---|---|---|---|
| D57 | 700 | 24 | 0.033 | 35.0 | 8.0 | 25.5 |
| | 700 | 26 | 0.6 | 9.1 | 11.0 | 39.5 |
| | 750 | 12 | 0.019 | 32.2 | 10.5 | 32.0 |

[a]All alloys heat treated according to Table II.

TABLE VIII

Creep Rupture Testing Results at 650° C

| Alloy | Stress, ksi | Min. Creep Rate %/hr. | Time at Stress, hr. R = Rupture | | Effective Rupture Life, Hr. | % E | % R.A. | 100-Hour Rupture Strength, ksi |
|---|---|---|---|---|---|---|---|---|
| D56 | 60.0 | — | .0125 | R | | — | — | |
| | 50.0 | 0.36 | 5.4 | R | | 4.0 | 8.0 | |
| | 45.0 | — | .53 | R | | — | — | |
| | 36.0 | 0.0048 | 205.4 | R | | 3.0 | 2.5 | 33 ± 5 |
| | 25.0 | — | 586.1 | R | | — | — | |
| D57 | 26.0 | 0.0015 | 310.5[a] | | 31.1 | | | |
| | 38.0 | 0.8 | 4.1 | R | 4.1 | | | |

TABLE VIII-continued

| Alloy | Stress, ksi | Min. Creep Rate %/hr. | Creep Rupture Testing Results at 650° C: Time at Stress, hr. R = Rupture | | Effective Rupture Life, Hr. | % E | % R.A. | 100-Hour Rupture Strength, ksi |
|---|---|---|---|---|---|---|---|---|
| | | | | | 35.2 | 8.0 | 20.5 | |
| | 30.0 | 0.003 | 412.3 | R | | 5.5 | 8.0 | 30 ± 2 |
| | 34.0 | 0.18 | 33.3 | R | | 16.0 | 38.0 | |
| | 41.5 | 8.0 | 0.8 | R | | 17.5 | 38.5 | |
| D58 | 12.5 | 0.0004 | 66.1[a] | | 0.14 | | | |
| | 16.0 | 0.0052 | 54.1[a] | | 1.15 | | | |
| | 25.0 | 0.028 | 23.9 | R | 23.9 | | | |
| | | | | | 25.19 | 15.0 | 32.0 | |
| | 19.0 | — | 23.1 | R | | — | — | 21 ± 1 |
| | 22.0 | 0.15 | 203.7 | R | | 7.0 | 8.5 | |
| | 29.0 | 0.35 | 17.0 | R | | 36.0 | 25.5 | |
| | 29.0 | — | 3.2 | R | | — | — | |
| D59 | 20.0 | 0.0024 | 555.7[a] | | 131.3 | | | |
| | 23.0 | — | 38.2 | R | 38.2 | | | |
| | | | | | 149.5 | 12.5 | 22.5 | |
| | 15.0 | — | 0.45 | R | | — | — | 22 ± 1 |
| | 25.0 | 0.37 | 34.1 | R | | 17.0 | 34.0 | |
| | 30.0 | — | >90 | R | | — | — | |
| | 32.7 | 2.81 | 1.8 | R | | 24.0 | 54.5 | |

[a]Stress was increased at this point.

What we claim is:

1. A high strength ferritic alloy having Laves phase precipitation as the primary ferritic alloy strengthener consisting essentially of from about 9% to about 13% by weight chromium, from about 4% to about 8% by weight molybdenum, from about 0.2% to about 0.8% by weight niobium, from about 0.1% to about 0.3% by weight vanadium, from about 0.2% to about 0.8% by weight silicon, from about 0.2% to about 0.8% by weight manganese, from 0.04% to about 0.12% by weight carbon, a maximum of about 0.05% by weight nitrogen, a maximum of about 0.02% by weight sulfur, a maximum of about 0.02% by weight phosphorus, and the balance iron, wherein said alloy will swell less than 5% at the fluence of $2.2 \times 10^{23}$ n/cm$^2$ (E > 0.1 MeV) and wherein said alloy exhibits 100 hour stress rupture strength in the range of about 30 ksi at 650° C.

2. The alloy of claim 1 consisting essentially of from about 9.5% to about 11.5% by weight chromium, from about 5.5% to about 6.5% by weight molybdenum, from about 0.3% to about 0.6% by weight niobium, from about 0.1% to about 0.3% by weight vanadium, from about 0.2% to about 0.5% by weight silicon, from about 0.3% to about 0.6% by weight manganese, from about 0.04% to about 0.07% by weight carbon, and the balance iron, and the maximum swelling rate of said alloy at the peak ion irradiation swelling temperature of about 500° C. is 0.0062% per dpa (iron ion) as determined at 250 dpa using 2.8 MeV iron ion irradiation, and the maximum iron irradiation swelling rate of said alloy at peak swelling temperature of about 550° C. is 0.564% dpa (electron).

3. The alloy of claim 1 consisting essentially of about 10.5% by weight chromium, about 6.0% by weight molybdenum, about 0.5% by weight niobium, about 0.3% by weight vanadium, about 0.3% by weight silicon, about 0.4% by weight manganese, and about 0.05% by weight carbon, and the balance iron.

* * * * *